US007557706B2

(12) United States Patent
Brown

(10) Patent No.: US 7,557,706 B2
(45) Date of Patent: Jul. 7, 2009

(54) SEAL

(75) Inventor: Andrew G. L. Brown, Durban (ZA)

(73) Assignee: Adams & Adams, Pretoria (ZA)

( * ) Notice: Subject to any disclaimer, the term of this patent is extended or adjusted under 35 U.S.C. 154(b) by 557 days.

(21) Appl. No.: 10/571,646

(22) PCT Filed: Jun. 24, 2004

(86) PCT No.: PCT/IB2004/001957

§ 371 (c)(1),
(2), (4) Date: Jun. 27, 2006

(87) PCT Pub. No.: WO2005/027079

PCT Pub. Date: Mar. 24, 2005

(65) Prior Publication Data

US 2007/0052539 A1 Mar. 8, 2007

(30) Foreign Application Priority Data

Sep. 15, 2003 (ZA) ..... 2003/7214
Mar. 24, 2004 (ZA) ..... 2004/2317

(51) Int. Cl.
*G08B 13/14* (2006.01)

(52) U.S. Cl. ..... 340/571; 340/542; 382/100

(58) Field of Classification Search ..... 340/571, 340/542, 539.1, 568.1; 382/100; 358/1.15, 358/1.18, 473; 347/109; 219/243; 280/738, 280/740; 235/454, 462.07; 701/2, 36; 156/325, 156/308.4

See application file for complete search history.

(56) References Cited

U.S. PATENT DOCUMENTS 4,041,705 A 8/1977 Siegel
6,069,563 A 5/2000 Kadner et al.
6,265,973 B1 7/2001 Brammall et al.
6,647,328 B2 * 11/2003 Walker ..... 701/36
7,466,444 B2 * 12/2008 Silverbrook et al. ..... 358/1.18
2004/0041705 A1 3/2004 Auerbach et al.

FOREIGN PATENT DOCUMENTS

WO WO 2004/021299 3/2004
WO WO 2004/075102 9/2004

OTHER PUBLICATIONS

Search report for International Application No. PCT/IB2004/001957 dated Oct. 14, 2004.

* cited by examiner

*Primary Examiner*—Anh Hong Do
(74) *Attorney, Agent, or Firm*—Marshall, Gerstein & Borun LLP

(57) ABSTRACT

This invention relates to a seal for sealing a freight container. The seal includes, in its in-use configuration, a shaft (18) and heads (20) on opposite ends thereof. It includes also an electronic circuit (40) including a radio frequency identification (RFID) transmitter (42) and sensing means (44, 46) for sensing severance of the shaft (18). Severance of the shaft (18), if sensed by the sensing means (44, 46), is detectable by interrogation of the RFID transmitter (42) via a compatible interrogation device. A basic embodiment of the seal comprises parts made mostly of a non-conductive, vulnerable material. Should operational requirements so dictate, additional parts are provided for effectively, in the in-use configuration of the seal, reinforcing the vulnerable parts to yield a tamper resistant seal which still may be interrogated to determine integrity of its shaft. Other embodiments of the seal permit also interrogation to determine the integrity of another part of the seal.

22 Claims, 10 Drawing Sheets

SEAL

THIS INVENTION relates to a seal.

A locking mechanism of a door of a known type of freight container includes parts defining therethrough holes that can be brought into register during locking of the mechanism so as to provide for a shaft of a matching seal to be inserted through them to seal the mechanism in its locked position, such a seal including, in use thereof, two heads at opposite ends of its shaft. The invention relates particularly to a seal which may be used to seal such a locking mechanism, although other applications for it may possibly be found.

According to a first aspect of the invention there is provided a seal including a first part including a shaft and a head at one end of the shaft, the shaft having engagement means in its end region remote from the head;

an electronic circuit carried by the first part and including a radio frequency identification (RFID) transmitter and sensing means for sensing severance of the shaft of the first part, the circuit being in a normal state and configured to, upon sensing severance of the shaft of the first part, change into a warning state, the state change being detectable by means of an interrogation device compatible with the RFID transmitter; and a second part defining a receiving formation for the shaft of the first part and having engagement means for irreleasibly engaging the end region of the shaft of the first part that has engagement means, via this engagement means, when received in its receiving formation, the second part forming a head at the end of the shaft of the first part remote from the head of the first part, when so engaged.

It is envisaged that, in use of the seal of the invention, an audit trail may be kept in respect of it in which the seal is associated with data stored in its RFID transmitter, which will include at least an identity of the seal. In order to check the integrity of the seal, the RFID transmitter may be interrogated by means of a compatible interrogation device.

The RFID transmitter of the electronic circuit carried by the first part may be a transponder. It may, more particularly, be any one of an active transponder, a true passive transponder, and a battery assisted passive transponder.

The seal may be configured so that, in the normal state of the electronic circuit carried by the first part, its RFID transmitter will respond to being interrogated by a compatible interrogation device by transmitting an RF signal incorporating an identity stored in it, and that, in the warning state, such transmission is disabled. Alternatively, it may be configured so that, in both the normal and warning states of the electronic circuit carried by the first part, its RFID transmitter will respond to being interrogated by a compatible interrogation device by transmitting an RF signal incorporating an identity stored in it as well as an indication of the state of the circuit.

The seal may include a spacer formation for operatively spacing the RFID transmitter from an external metal object to prevent interference with its operation.

The receiving formation defined by the second part for receiving the region of the shaft of the first part defining its engagement means may be a socket formation defining a generally round cylindrical inner surface of a diameter matching that of the shaft in the region referred to.

The seal may include an electronic circuit carried by the second part, including an RFID transmitter and sensing means for sensing tampering with the second part, the circuit being in a normal state and configured to, upon sensing such tampering, change into a warning state, the state change being detectable by means of an interrogation device compatible with the RFID transmitter. The RFID transmitter of this circuit may be a transponder. It may, more particularly, be any one of an active transponder, a true passive transponder, and a battery assisted passive transponder. The sensing means of the electronic circuit carried by the second part may define an electrically conductive path in a configuration with respect to the second part in which damage to the second part, when engaged with the first part, required for its removal from the first part, will cause severance of the conductive path, the circuit being configured to undergo the state change referred to upon sensing severance of the path. The electrically conductive path of the electronic circuit carried by the second part may be defined by an electrically conductive element.

The sensing means of the electronic circuit carried by the first part may define a primary electrically conductive path extending along the length of the shaft of the first part in a configuration in which severance of the shaft between its engagement means and the head of the first part will cause severance of the path also, the circuit being configured to undergo the state change referred to upon severance of the path. The combination of the primary conductive path and the RFID transmitter of the electronic circuit carried by the first part may define a closed loop extending along the length of the shaft of the first part. The primary electrically conductive path of the electronic circuit carried by the first part may be defined by an electrically conductive element. As such, at least a part of the conductive element of the electronic circuit carried by the first part may be inside the shaft of the first part. As such, the shaft of the first part may be at least partially made of a moulded electrically non-conductive material and the part of the conductive element of the electronic circuit carried by the first part inside the shaft of the first part may be moulded into it.

In the case of the electronic circuit carried by the first part including a primary electrically conductive element, as defined, the circuit may define also a secondary electrically conductive path which extends along the length of the shaft of the first part and which is electrically isolated from the primary conductive path, the circuit being configured to be in its warning state during electrical contact between its conductive paths. This arrangement may serve, in some applications of the seal, to impair restoration of the electronic circuit to its normal state, after severance of the primary conductive element, by means of a substance such as a conductive resin or paste. Such restoration may cause contact also between the primary and secondary conductive elements, thus rendering the circuit still in its warning state. The primary electrically conductive path of the electronic circuit carried by the first part may be defined by an electrically conductive element.

The head formed by the second part at the end of the shaft of the first part remote from the head of the first part, when the parts are interengaged, may be made of a tamper resistant material.

In one particular embodiment of the seal of the invention in which the head formed by the second part at the end of the shaft of the first part remote from the head of the first part, when the parts are interengaged, is made of a tamper resistant material, the seal includes a third part and the third part is made of a tamper resistant material and includes a shaft and a head at one end of the shaft, the shaft having engagement means in its end region remote from its head and the part defining therethrough a passage for receiving the shaft of the first part, the passage daylighting on opposite ends thereof in the head of the third part and in the end of its shaft remote from its head;

the second part defines a receiving formation for the shaft of the third part and has engagement means for irreleasibly engaging the end region of the shaft of the third part that has engagement means, via this engagement means, when received in its receiving formation; and the parts are shaped to provide an in-use configuration of the seal in which, with the shaft of the third part engaged with the second part, a portion of the shaft of the first part is received in the passage defined through the third part, the head of the first part is adjacent to the head of the third part, and the region of the shaft of the first part defining its engagement means projects from the shaft of the third part and is received within and irreleasibly engaged by the receiving formation defined for it by the second part.

The receiving formation defined by the second part for receiving the region of the shaft of the third part defining its engagement means may be a socket formation defining a generally round cylindrical inner surface of a diameter matching that of the shaft in the region referred to and that for the corresponding region of the shaft of the first part may be a socket formation defining a generally round cylindrical inner surface of a diameter matching that of the shaft in the region referred to, co-axial with the former cylindrical surface, the latter socket formation daylighting in the former.

In a further particular embodiment of the seal of the invention in which the head formed by the second part at the end of the shaft of the first part remote from the head of the first part, when the parts are interengaged, is made of a tamper resistant material, the seal includes a third and a fourth part and the third part is made of a tamper resistant material and includes a shaft and a head at one end of the shaft, the shaft having engagement means in its end region remote from the head;

the fourth part is made of a tamper resistant material and defines a receiving formation for the shaft of the third part and has engagement means for irreleasibly engaging the end region of the shaft of the third part that has engagement means via its engagement means when received in its receiving formation, the fourth part forming a head at the end of the shaft of the third part remote from the head of the third part, when so engaged;

with the third part engaged with the fourth part, the combination of the two parts defines a tamper resistant seal body comprising the two heads of the respective parts and the shaft of the third part interconnecting them, the seal body defining therethrough, particularly also through its shaft, a passage for receiving the shaft of the first part, the passage daylighting on opposite ends thereof in the respective heads of the seal body; and the parts are shaped to provide an in-use configuration of the seal in which, with the third part engaged with the fourth part to define a tamper resistant seal body, a portion of the shaft of the first part is received in the passage defined through the seal body and the first part is engaged with the second part with the heads of these parts on opposite sides of the seal body.

The receiving formation defined by the fourth part for receiving the region of the shaft of the third part defining its engagement means may define a generally round cylindrical inner surface of a diameter matching that of the shaft in the region referred to.

Generally, for all the embodiments of the seal of the invention, any of the conductive paths referred to may be defined by a suitably applied electrically conductive ink. Any of the conductive elements referred to may particularly be a microfilament.

Generally, for all the embodiments of the seal of the invention, the sensing means of the electronic circuit carried by the first part may, alternatively or additionally, include also another type of sensing means for sensing any form of deformation, indicative of tampering, of the shaft of the first part, e.g. a strain gauge, a piezoelectric element, and the like. As such, what is stated above in relation to a seal in which the electronic circuit carried by the first part includes an electrically conductive element applies, mutatis mutandis, to a seal including another type of means for sensing deformation indicative of tampering. The same applies to the electronic circuit carried by another part, where provided.

It is envisaged that the seal of the invention will mostly be used for sealing the locking mechanisms of freight containers. It must be appreciated, however, that such a seal may similarly be used for other sealing purposes.

The invention is described below by way of example with reference to and as illustrated in the accompanying diagrammatic drawings. In the drawings.

Figure 1:
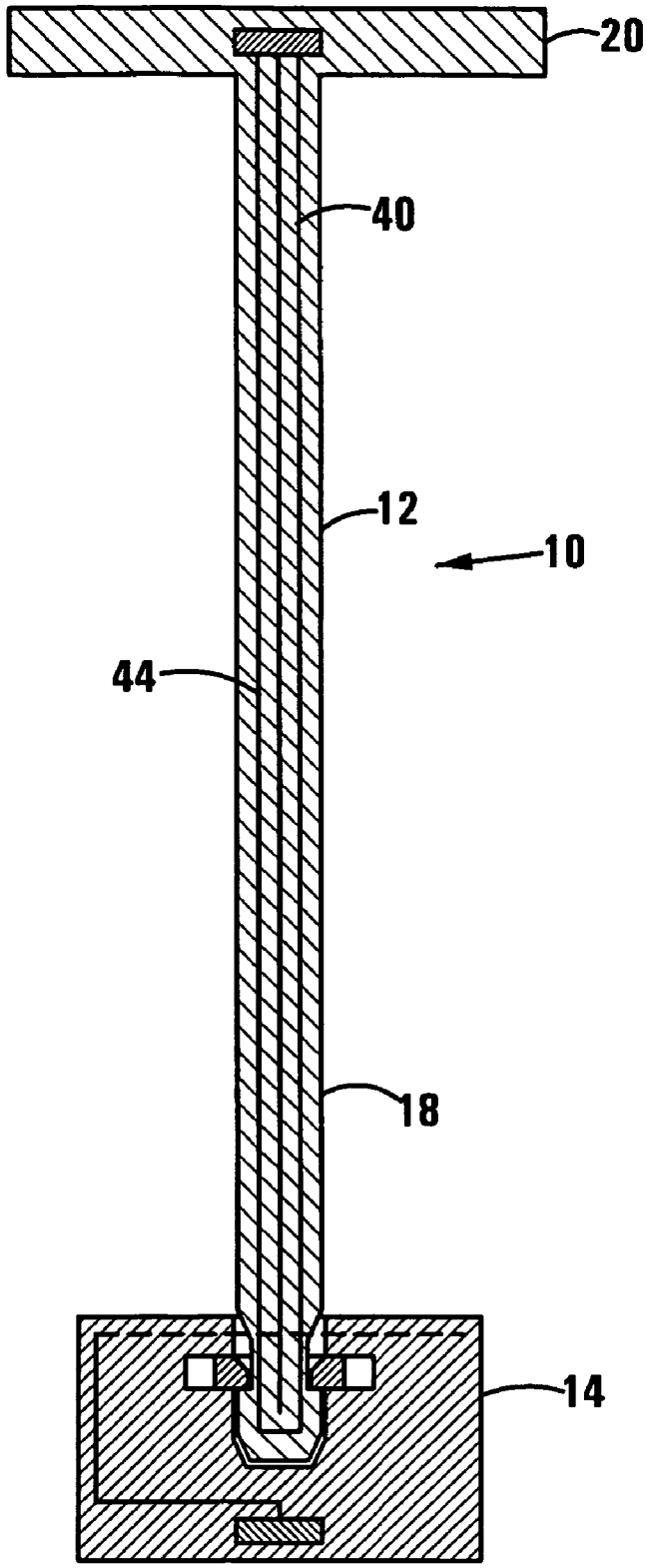
FIG. 1 illustrates diagrammatically, in long section, a first embodiment of a seal, in accordance with the invention, in an assembled configuration.

In FIG. 1, a first embodiment of a seal, in accordance with the invention, is designated generally by the reference numeral 10. The seal 10 includes a first part 12 and a second part 14.

Figure 2:
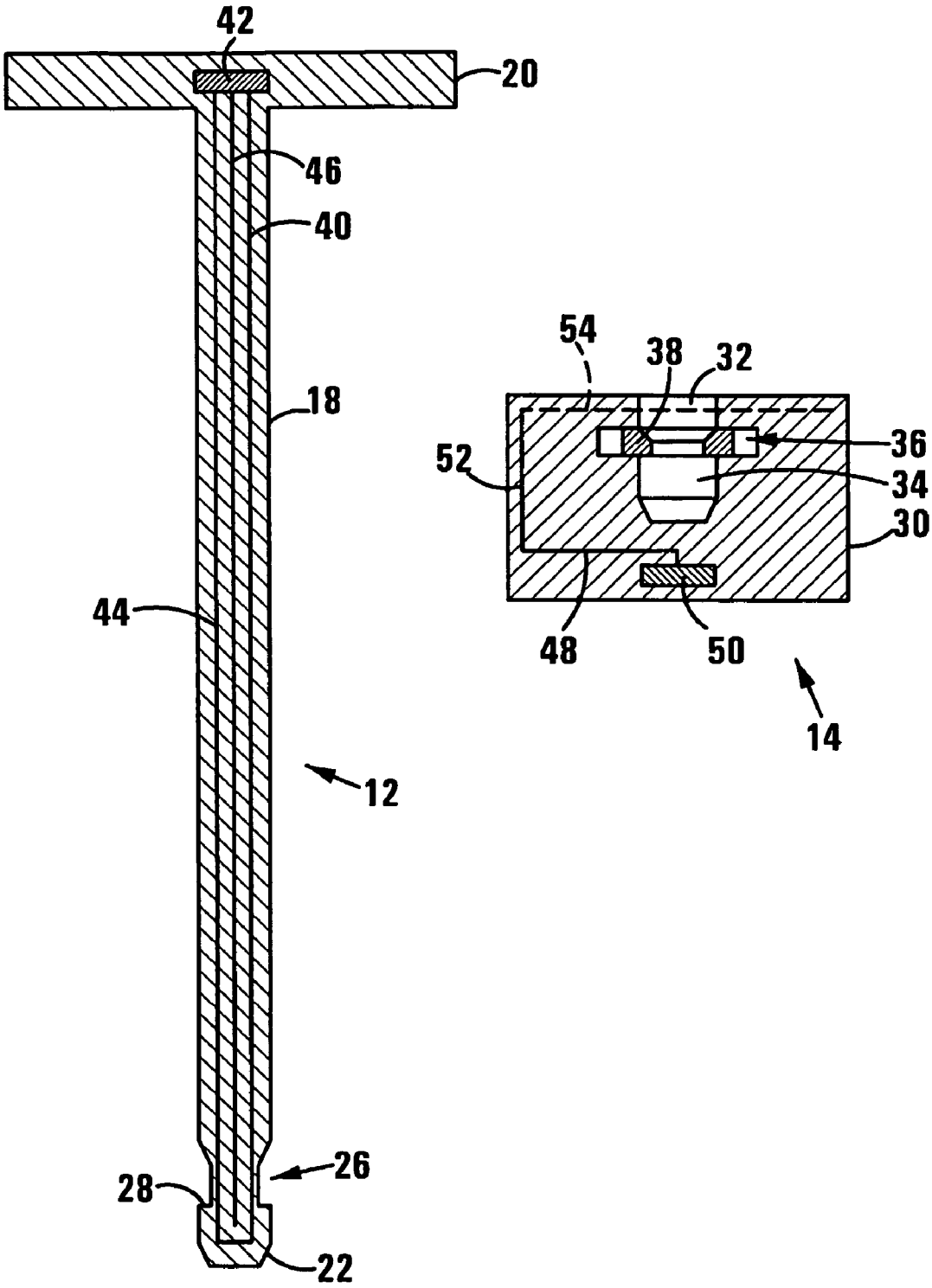
FIG. 2 illustrates diagrammatically, in long section, parts from which the seal of FIG. 1 was assembled.

With reference particularly to FIG. 2, the first part 12 includes a generally round cylindrical shaft 18 and a head 20 at one end of the shaft. The shaft 18 and the head 20 are integrally formed of an injection moulded plastics material. The shaft 18 defines a tapered leading end 22 remote from the head 20. A peripheral slot 26 is defined in the shaft 18 in and end region thereof including the end 22. As such, the shaft 18 defines engagement means in the form of a peripheral shoulder formation 28 on the side of the slot 26 proximate to the end 22. The purpose of the shoulder formation 28 will become apparent from the remainder of this description.

The second part 14 also is made of an injection moulded plastics material and defines a round cylindrical outer surface 30. The part 14 defines a receiving formation in the form of a socket formation 32 for receiving the end region of the shaft 18 including the shoulder formation 28. The socket formation 32 defines a round cylindrical inner surface 34 matched to that of the shaft 18 to provide a snug fit of the shaft in the socket formation. The socket formation 32 has received in a peripheral slot 36 defined around it shaft engagement means in the form of a circlip 38 for engaging the shoulder formation 28 of the shaft 18. The engaged configuration is shown in FIG. 1 and in this configuration, the second part 14 forms a head at the end of the shaft 18 remote from the head 20.

With reference still particularly to FIG. 2, the first part 12 carries an electronic circuit 40 including a radio frequency identification (RFID) transmitter 42, a primary electrically conductive element 44, defining a U shape of which the legs extend along the length of the shaft 18 and through the region of the shaft defining the slot 26, and a secondary conductive element 46 also extending along the length of the shaft 18 and electrically isolated from the element 44. The transmitter 42 particularly is a battery assisted passive transponder. The circuit 40 is moulded into the part 12 with the transmitter 42 in the head 20. Clearly, the combination of the primary conductive element 44 and the RFID transmitter 42 defines a closed loop extending along the length of the shaft 18.

In an alternative embodiment of the seal of the invention (not shown), the RFID transmitter 42 may be of another type, e.g. one of an active transponder and a true passive transponder.

The circuit 40 is shown in a normal state in which its RFID transmitter 42 will respond to being energised by an external interrogation device (not shown) by transmitting an RF signal incorporating an identity of the seal 10 stored in the transmitter. Should the element 44 be severed, the state of the circuit 40 is changed into a warning state, in which transmission of a signal by the transmitter 42 is disabled. As such, in use of the seal 10 of FIG. 1, the conductive element 44 serves as sensing means for sensing severance of the shaft 18 and for changing the state of the circuit 40 from its normal state into its warning state in response thereto.

In an alternative embodiment of the seal of the invention not shown, an electronic circuit similar to that described above may be configured so that, in both its normal and warning states, its RFID transmitter will respond to being interrogated by a compatible interrogation device by transmitting an RF signal incorporating an identity stored in it as well as an indication of the state of the circuit. The requirement merely is that the state of the circuit is changed in a manner detectable by an external interrogation device.

The circuit 40 is configured to be in its warning state if there is direct electrical contact between its conductive elements. As such, should the shaft 18, and accordingly the conductive element 44, be severed during use of the seal 10 (see FIG. 1) an attempt to "repair" the conductive element 44 by means of a substance such as a conductive resin or paste will most likely cause electrical contact between the elements 44 and 46 also, thus rendering the circuit 40 in its warning state.

The second part 14 has an electronic circuit 48 moulded therein. It includes an RFID transmitter 50 similar to the transmitter 42 and an electrically conductive element 52 connected thereto to form a closed loop (partially shown). The circuit 48 is shown in a normal state in which its RFID transmitter 50 will respond to being energised by an external interrogation device (not shown) by transmitting an RF signal incorporating an identity of the seal 10 (see FIG. 1) stored in the transmitter. Should the element 52 be severed, the state of the circuit 48 is changed into a warning state. In this state, transmission of a signal by the transmitter 50 is disabled. A portion of the element 52 defines a ring 54 around the socket formation 32. It is envisaged that damage to the second part 14, when engaged with the first part 12, required for its removal from the first part will cause severance of the element 54. The circuit 48 will then be in its warning state.

As such, in order to check the integrity of the seal 10 of FIG. 1 by means of a compatible interrogation device, both the RFID transmitters 42 and 50 are interrogated and only if both respond is the integrity of the seal deemed confirmed. A benefit of having two electronic circuits is that, if one of them is rendered in its warning state, i.e. inoperative, due to damage to the seal 10, the other may still be interrogated to determine its identity in order to identify the seal.

All parts of the seal 10 are sacrificial. The seal 10 may be used to seal a locking mechanism in an application where mechanical strength of the seal is not a requirement. It merely serves to indicate whether or not there was tampering with the seal. Other embodiments of the seal of the invention provide mechanical resistance to tampering also. Such embodiments will be described hereinafter.

Figure 3:
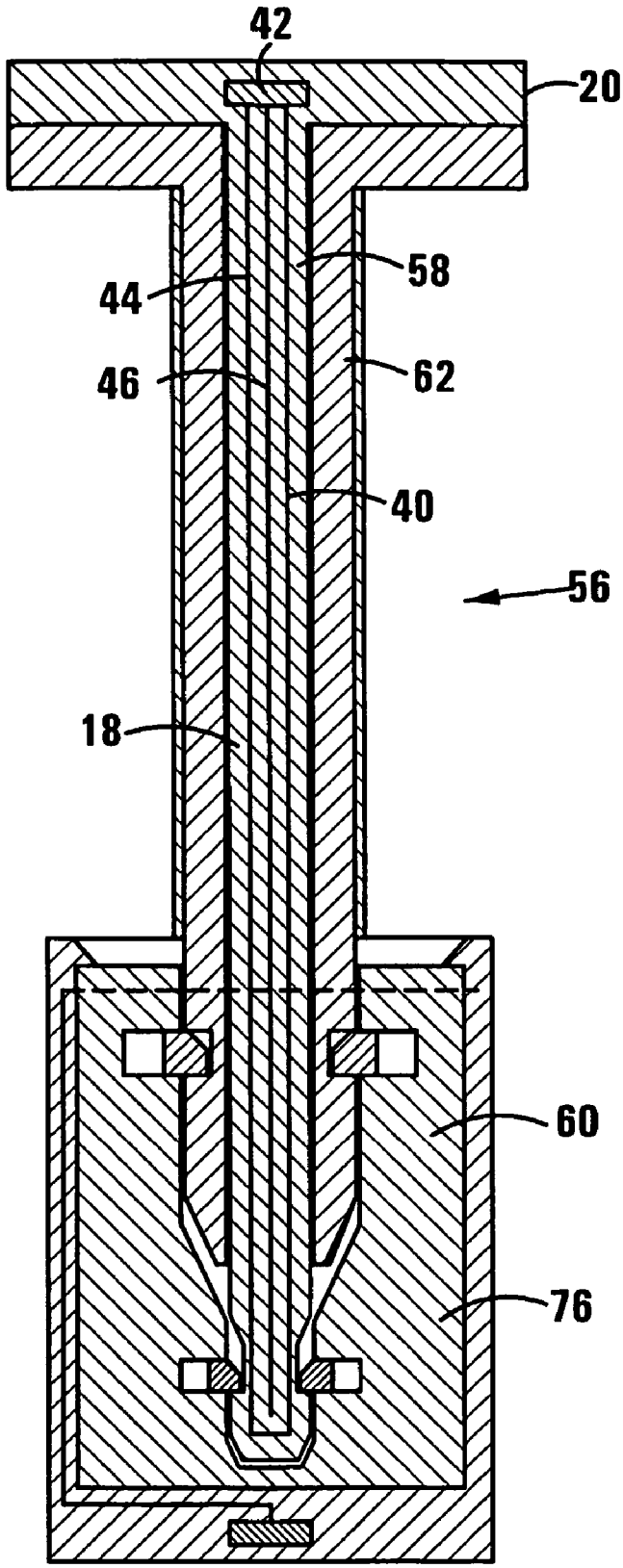
FIG. 3 illustrates diagrammatically, in long section, a second embodiment of a seal, in accordance with the invention, in an assembled configuration.

In FIG. 3, a second embodiment of a seal, in accordance with the invention, is designated generally by the reference numeral 56. The seal 56 includes a first part 58, a second part 60, and a third part 62.

Figure 4:
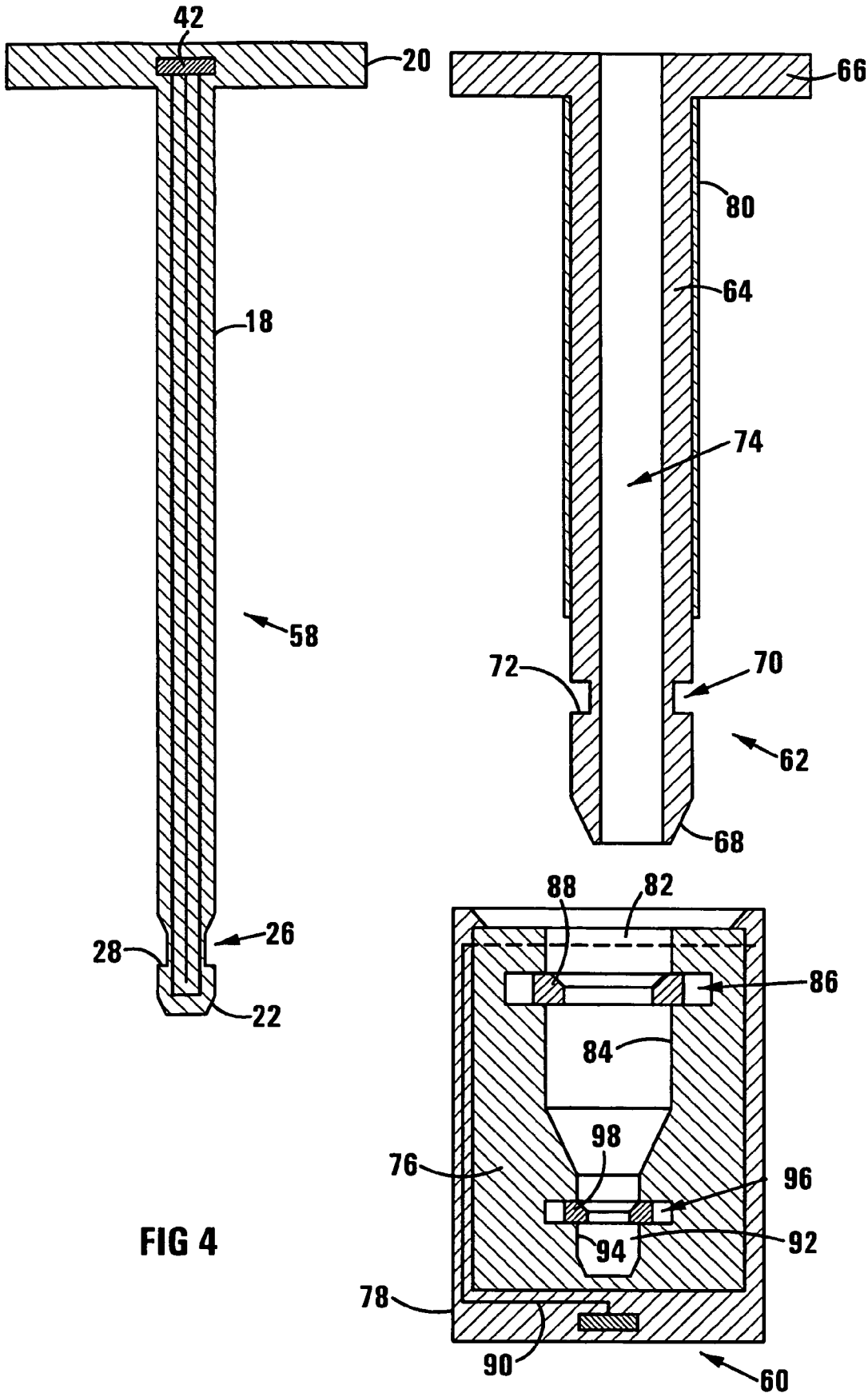
FIG. 4 illustrates diagrammatically, in long section, parts from which the seal of FIG. 3 was assembled.

With reference particularly to FIG. 4, the first part 58 is identical to the part 12 of FIG. 2. Identical features, where designated, are thus designated by the same reference numerals as before and a description of these features may be found in the description above of FIGS. 1 and 2.

The third part 62 includes a shaft 64 and a head 66 at one end of the shaft, integrally formed of a corrosion and tamper resistant material in the form of aluminium. The shaft 64 defines a tapered end 68 remote from the head 66. In an end region of the shaft 64 including the end 68, it defines a peripheral slot 70 and a peripheral shoulder formation 72 on the side of the slot 70 remote from the head 66. The shoulder formation 72 defines engagement means for the shaft 64, as will be described hereinafter. The part 62 defines through it a passage 74, which daylights on opposite ends thereof in the head 66 and the end 68 of the shaft 64. The diameter of the passage 74 is matched to the outer diameter of the shaft 18 of the part 58 so that the shaft 18 may be snugly received within the passage 74.

The second part 60 includes a part 76 made of aluminium and an outer shell 78 for the part 76. The shell 78 is made of a strong but brittle plastics material susceptible to damage due to tampering and, as such, serves as tamper indication means for the part 60. The part 62 has a sleeve 80 made of the same material and serving a similar purpose.

The part 76 of the part 60 defines therein a receiving formation in the form of a socket formation 82 for receiving the region of the shaft 64 of the part 62 including the shoulder formation 72. The socket formation 82 defines a round cylindrical inner surface 84 of a diameter matched to the outer diameter of the shaft 64 to provide a snug fit of the shaft in the socket formation 82. The socket formation 82 defines around it a peripheral slot 86 in which a circlip 88 is received. The circlip 88 serves as engagement means for irreleasably engaging the shoulder formation 72 of the shaft 64 of the part 62 when the end region of the shaft including the shoulder formation is within the socket formation 82. Engagement of the end region of the shaft 64 with the part 76 is effected by merely forcing the end region into the socket formation 82, the leading tapered end 68 of the shaft 64 forcing the circlip 88 open and the circlip 88 subsequently partially lodging itself in the slot 70. In this configuration, illustrated in FIG. 3, the parts 62 and 60 are irreleasably engaged with the part 76 forming a head for the shaft 64 on its end remote from the head 66.

The shell 78 of the part 60 has an electronic circuit 90 moulded therein. The circuit 90 is similar to the circuit 48 of the part 14 of FIG. 2 and, as such, will not be described herein in detail. Suffice it to say that it is envisaged that damage to the part 60 required for its removal from the part 62, when the parts are inter-engaged, would result in a change of the circuit 90 into its warning state.

The part 76 of the part 60 defines therein also a receiving formation in the form of a socket formation 92 for receiving the region of the part 58 including the shoulder formation 28. The socket formation 92 defines a cylindrical inner surface 94 matched to the outer diameter of the shaft 18 of the part 58 to provide a snug fit of the shaft in the socket formation. The surfaces 84 and 94 of the socket formations 82 and 92, respectively, are co-axial and the latter socket formation daylights in the former. The socket formation 92 defines around it a peripheral slot formation 96 within which a circlip 98 is received.

With reference to FIGS. 3 and 4 generally, in order to assemble the seal 56, first the parts 62 and 60 are suitably aligned and the end region of the shaft 64 of the part 62 remote from the head 66 is linearly displaced into the socket formation 82 until the shoulder formation 72 is engaged by the circlip 88. The part 58 then is suitably aligned with the combination of the part 60 and 62 and the shaft 18 of the part 58 inserted into the passage 74 defined through the part 62. The shaft 18 then is linearly displaced along the passage 74 until the shoulder formation 28 is engaged by the circlip 98. In this configuration, a portion of the shaft 18 is received within the passage 74 and a portion thereof protruding from the shaft 64 is received in the socket formation 92. The head 20 of the part 58 is adjacent to the head 66 of the part 62. Clearly, before the seal 56 is assembled in accordance with what is stated above, the shaft 64 of the part 62 is inserted through holes defined through parts of a locking mechanism of a door of a freight container and, after the seal has been assembled, the locking mechanism is rendered both locked and sealed via the seal 56.

All parts of the seal 56 (see FIG. 3) are sacrificial.

Figure 5:
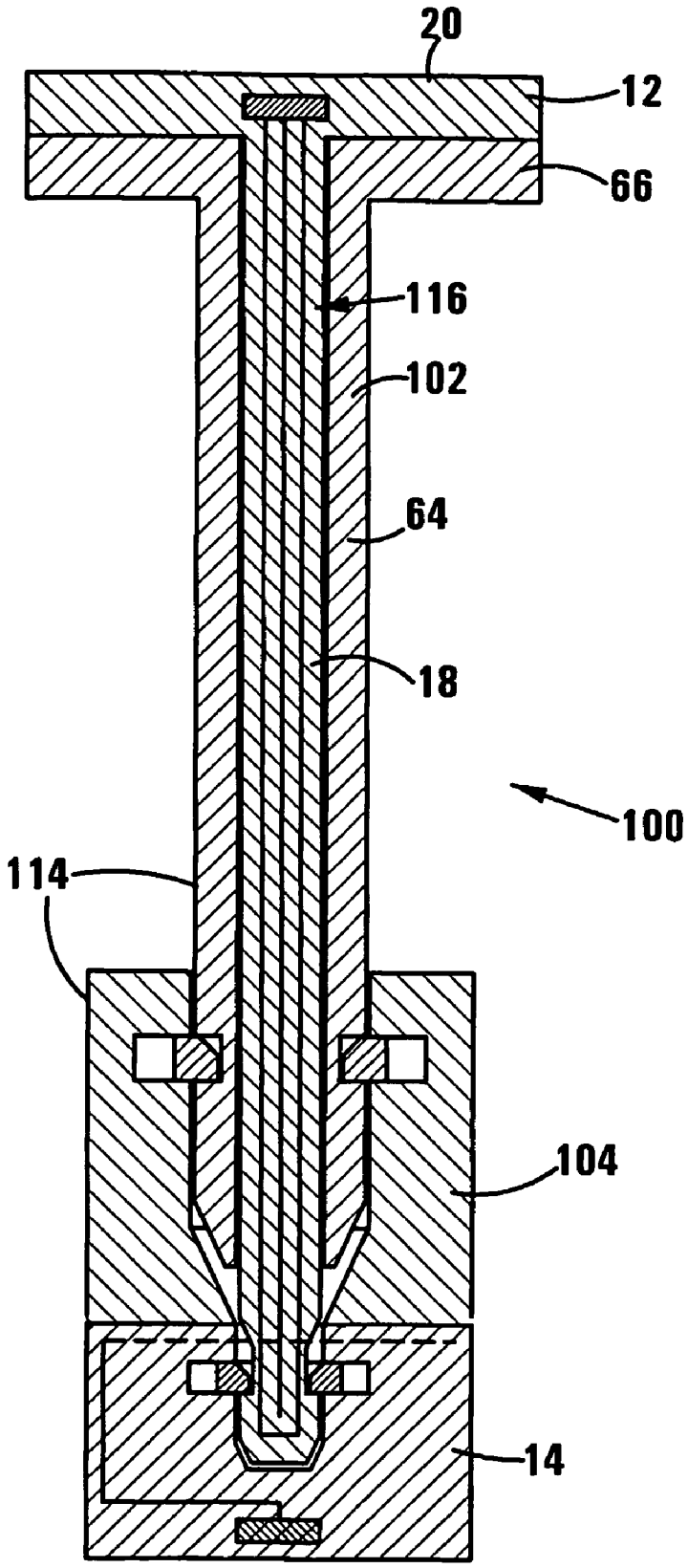
FIG. 5 illustrates diagrammatically, in long section, a third embodiment of a seal, in accordance with the invention, in an assembled configuration.

In FIG. 5, a third embodiment of a seal, in accordance with the invention, is designated generally by the reference numeral 100. This seal 100 includes a first part and a second part identical to the first and second parts 12 and 14, respectively, of the seal 10 of FIG. 1. As such, these parts are designated again by the same reference numerals as before. Like features, where designated, also are designated again by the same reference numerals as before and a description of these features may be found in the description above of FIGS. 1 and 2.

The seal 100 includes also a third part 102 comprising a shaft and head identical to the shaft 64 and the head 66 of the part 62 of FIG. 4. Like features, where designated, are thus designated again by the same reference numerals as before and a description of these features may be found in the description above of FIG. 4. The seal 100 includes also a fourth part 104, made of aluminium.

Figure 6:
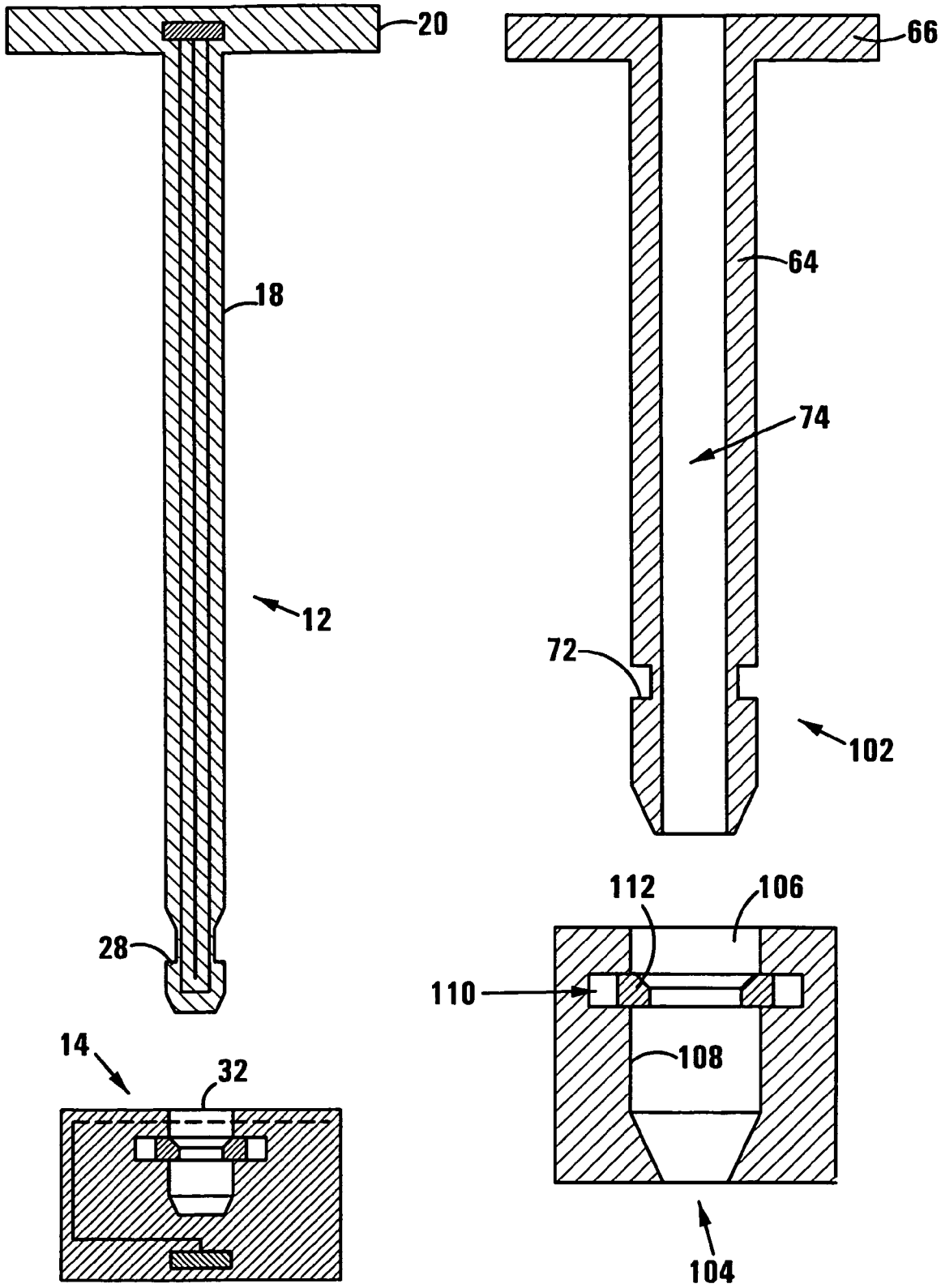
FIG. 6 illustrates diagrammatically, in long section, parts from which the seal of FIG. 5 was assembled.

With reference particularly to FIG. 6, the part 104 defines therein a receiving formation 106 defining a round cylindrical inner surface 108 matching the outer diameter of the shaft 64 to provide a snug fit of the end region of the shaft 64 including the shoulder formation 72 in the receiving formation 106. The receiving formation 106 defines around it a peripheral slot 110 within which engagement means in the form of a circlip 112 is received. When the shaft 64 of the part 102 is engaged with the part 104, the shoulder formation 72 is engaged by the circlip 112. This configuration is shown in FIG. 5.

In the configuration shown in FIG. 5, the combination of the parts 102 and 104 forms a tamper resistant seal body 114 comprising the shaft 64, the head 66 at one end of the shaft 64, and a head formed by the part 104 at the end of the shaft 64 remote from the head 66. The seal body 114 defines therethrough a passage 116 daylighting on opposite sides thereof in the head 66 and the part 104. Also in the configuration shown here, the shaft 18 of the part 12 has been inserted into the passage 116 so that a part thereof is received in the passage and an end region including the shoulder formation 28 (see FIG. 6) of the shaft 18 is received within the socket formation 32 (see FIG. 6) of the part 14. The head 20 and the head formed by the part 14 abut against the seal body 114 on opposite sides thereof.

All parts of the seal 100 are sacrificial. Again, the seal 100 may be used to both lock and seal a locking mechanism of a freight container.

Figure 7:
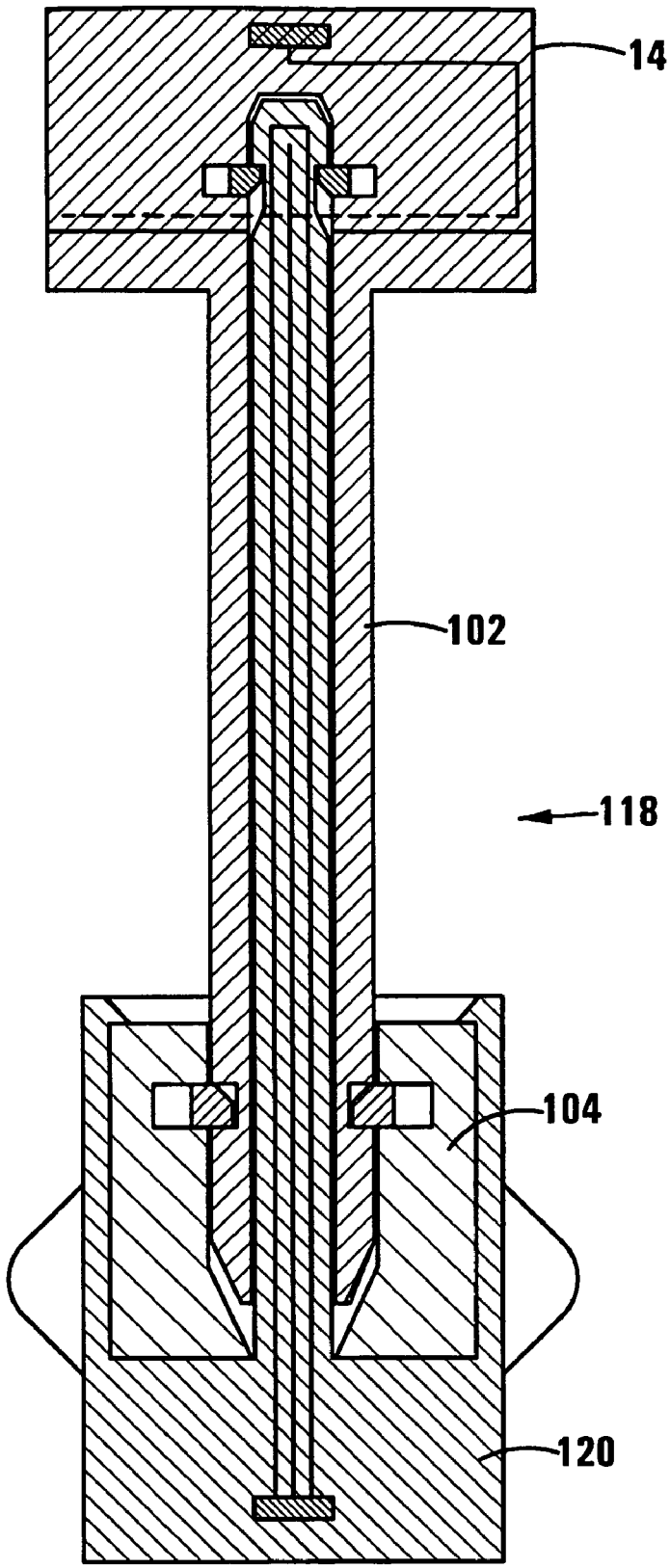
FIG. 7 illustrates diagrammatically, in long section, a fourth embodiment of a seal, in accordance with the invention, in an assembled configuration.

In FIG. 7, a fourth embodiment of a seal, in accordance with the invention, is designated generally by the reference numeral 118. The seal 118 includes some features that are similar to corresponding features of the seal 10 of FIG. 1. Similar features, where designated, are thus designated, both in FIGS. 7 and 8, by the same reference numerals as before and a description of these features may be found in the description above of FIGS. 1 and 2.

Figure 8:
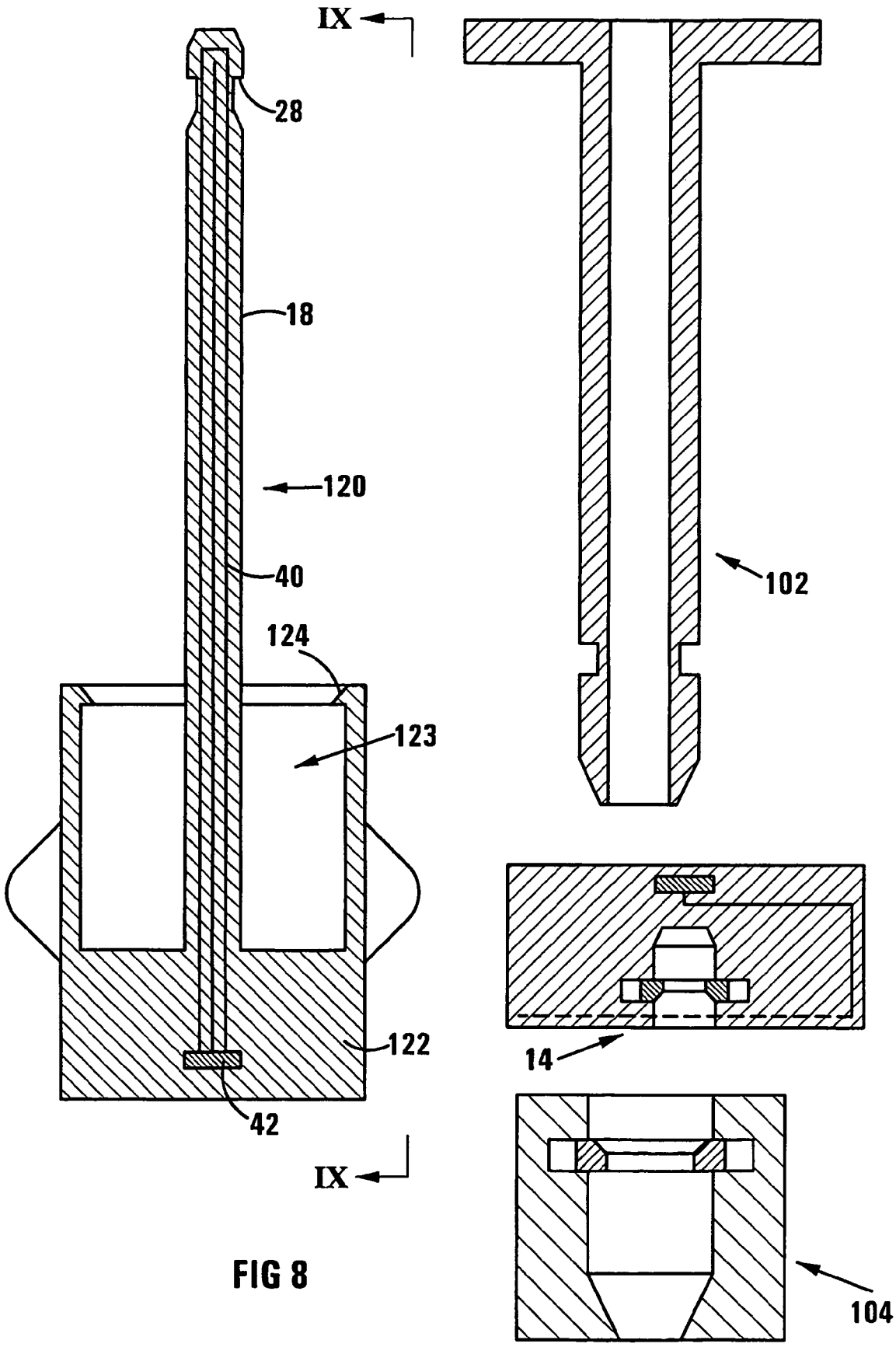
FIG. 8 illustrates diagrammatically, in long section, parts from which the seal of FIG. 7 was assembled.

With reference particularly to FIG. 8, the seal 118 of FIG. 7 includes a first part 120 including some features that are similar to corresponding features of the part 12 of the seal 10 of FIG. 1. The seal 118 includes also a third part and a fourth part identical to the third and fourth parts 102 and 104 of FIG. 6 and designated again by the same reference numerals as before. It still further includes a second part 14 similar to the second part 14 of FIG. 2. General descriptions of these parts may thus be found in the relevant portions of the description above.

With reference particularly to FIG. 8, the part 120 defines a head 122 corresponding to the head 20 of the part 12 of FIG. 2. The head 122 defines therein a space 123 for receiving the part 104 and a peripheral lip 124 for engaging the part 104.

Figure 9:
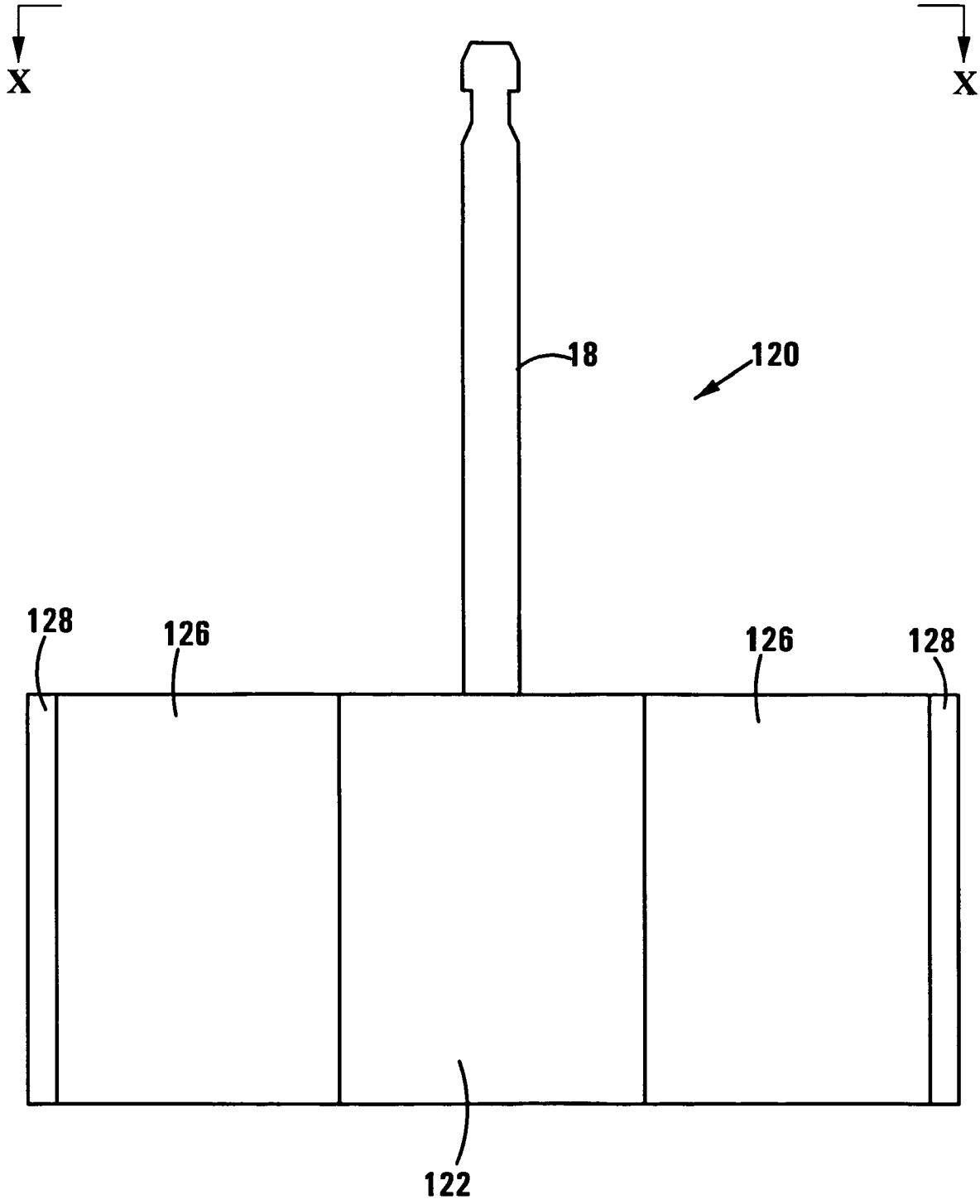
FIG. 9 illustrates diagrammatically one of the parts of FIG. 8 in the direction of arrows IX-IX of FIG. 8.
Figure 10:
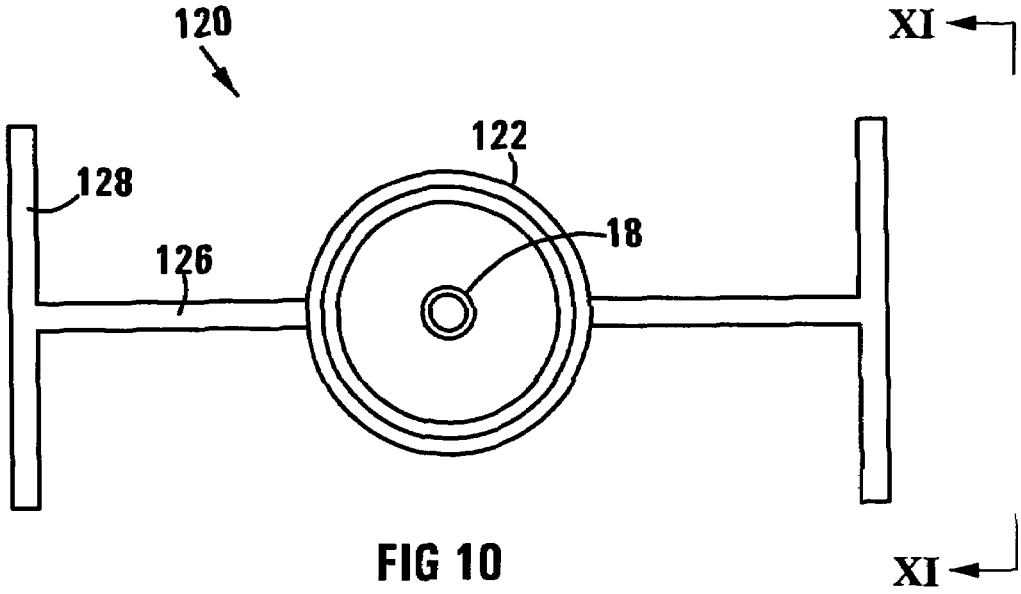
FIG. 10 illustrates diagrammatically the part of FIG. 9 in the direction of arrows X-X of FIG. 9.
Figure 11:
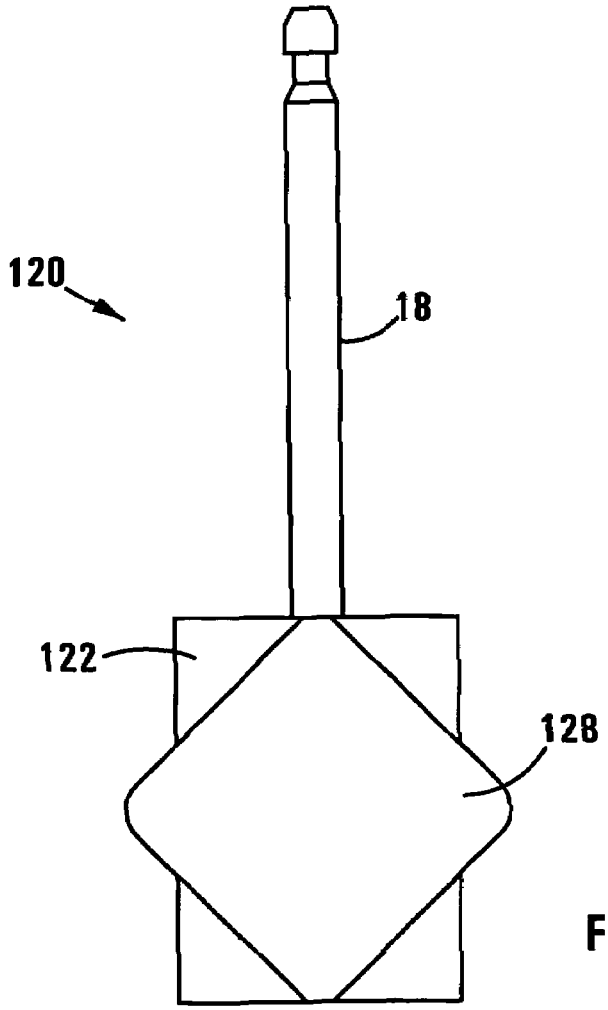
FIG. 11 illustrates diagrammatically the part of FIG. 9 in the direction of arrows XI-XI of FIG. 10.

With reference particularly to FIGS. 8 and 9, the part 120 has a spacer formation including two walls 126 (see FIG. 9) extending from the head 122 in opposite directions and a transverse end wall 128 at the outer end of each wall 126. The purpose of the spacer formation is to operatively space the RFID transmitter 42 (see FIG. 8) from any metal surface to prevent interference with its operation. The spacer formation may include RF reflective elements for enhancing a signal transmitted by the RFID transmitter to facilitate "reading" of the data incorporated in the signal over a distance. Clearly, in any one of the seals illustrated in the drawings, similar spacer formations may be provided to operatively space any of the other RFID transmitters illustrated from any metal surface to prevent interference with its operation.

All parts of the seal 118 (see FIG. 7) are sacrificial.

In an alternative embodiment of the seal of the invention not shown, another suitable type of engagement means may be substituted for any one of the circlips referred to above.

In an alternative embodiment of the seal of the invention not shown, any part described above as being made of aluminium may be made of another type of tamper resistant material, e.g. stainless steel. Such a material may particularly be a corrosion resistant material.

Also in another alternative embodiment of the seal of the invention not shown, the sensing means may include another type of means for sensing deformation of the shaft of the first part of the seal, e.g. a strain gauge, a piezoelectric element, and the like. As such, what is stated above in relation to a seal including an electrically conductive element applies, mutatis mutandis, to a seal including another type of means for sensing deformation.

It is envisaged that the seal of the invention will mostly be used for sealing freight containers. Using matching interrogation devices located at strategic positions along a transportation route of a container sealed with a seal, in accordance with the invention, the integrity of its seal may be monitored. If the seal fails to respond to being energised by an interrogation device by transmitting an RFID signal, a vehicle transporting the container may be stopped by a relevant authority to ascertain the cause of the failure.

The invention claimed is:

1. A seal including a first part including a shaft and a head at one end of the shaft, the shaft having engagement means in its end region remote from the head;

an electronic circuit carried by the first part and including a radio frequency identification (RFID) transmitter and sensing means for sensing severance of the shaft of the first part, the circuit being in a normal state and configured to, upon sensing severance of the shaft of the first part, change into a warning state, the state change being detectable by means of an interrogation device compatible with the RFID transmitter;

a second part defining a receiving formation for the shaft of the first part and having engagement means for irreleasibly engaging the end region of the shaft of the first part that has engagement means, via this engagement means, when received in its receiving formation, the second part forming a head at the end of the shaft of the first part remote from the head of the first part, when so engaged;

a third part made of a tamper resistant material and including a shaft and a head at one end of the shaft, the shaft having engagement means in its end region remote from its head and the part defining therethrough a passage for receiving the shaft of the first part, the passage daylighting on opposite ends thereof in the head of the third part and in the end of its shaft remote from its head; and a part made of a tamper resistant material and defining a receiving formation for the shaft of the third part and having engagement means for irreleasibly engaging the end region of the shaft of the third part that has engagement means via its engagement means when received in its receiving formation, the part defining the receiving formation for the shaft of the third part forming a head at the end of the shaft of the third part remote from the head of the third part, when so engaged, the parts being shaped to provide an in-use configuration of the seal in which, with the third part engaged with the part defining the receiving formation for the shaft of the third part, a portion of the shaft of the first part is received in the passage defined through the shaft of the third part and the region of the shaft of the first part defining its engagement means projects from the third part and is received within and irreleasibly engaged by the receiving formation defined for it by the second part.

2. A seal as claimed in claim 1, in which the RFID transmitter is a transponder.

3. A seal as claimed in claim 1, in which, in the normal state of the electronic circuit carried by the first part, its RFID transmitter will respond to being interrogated by a compatible interrogation device by transmitting an RF signal incorporating an identity stored in it, and in which, in the warning state, such transmission is disabled.

4. A seal as claimed in claim 1, in which, in both the normal and warning states of the electronic circuit carried by the first part, its RFID transmitter will respond to being interrogated by a compatible interrogation device by transmitting an RF signal incorporating an identity stored in it as well as an indication of the state of the circuit.

5. A seal as claimed in claim 1, which includes a spacer formation for operatively spacing the RFID transmitter from an external metal object to prevent interference with its operation.

6. A seal as claimed in claim 1, in which the receiving formation defined by the second part for receiving the region of the shaft of the first part defining its engagement means is a socket formation defining a generally round cylindrical inner surface of a diameter matching that of the shaft in the region referred to.

7. A seal as claimed in claim 1, which includes an electronic circuit associated with the second part, including an RFID transmitter and sensing means for sensing possible tampering with the second part, the circuit being in a normal state and configured to, upon sensing such tampering, change into a warning state, the state change being detectable by means of an interrogation device compatible with the RFID transmitter.

8. A seal as claimed in claim 7, in which the RFID transmitter of the electronic circuit carried by the second part is a transponder.

9. A seal as claimed in claim 7, in which the sensing means of the electronic circuit carried by the second part defines an electrically conductive path in a configuration with respect to the second part in which damage to the second part, when engaged with the first part, required for its removal from the first part, will cause severance of the path, the circuit being configured to undergo the state change referred to upon sensing severance of the path.

10. A seal as claimed in claim 9, in which the electrically conductive path of the electronic circuit carried by the second part is defined by an electrically conductive element.

11. A seal as claimed in claim 1, in which the sensing means of the electronic circuit carried by the first part defines a primary electrically conductive path extending along the length of the shaft of the first part in a configuration in which severance of the shaft between its engagement means and the head of the first part will cause severance of the path also, the circuit being configured to undergo the state change referred to upon severance of the path.

12. A seal as claimed in claim 11, in which the combination of the primary conductive path and the RFID transmitter of the electronic circuit carried by the first part defines a closed loop extending along the length of the shaft of the first part.

13. A seal as claimed in claim 11, in which the primary electrically conductive path of the electronic circuit carried by the first part is defined by an electrically conductive element.

14. A seal as claimed in claim 13, in which at least a part of the conductive element of the electronic circuit carried by the first part is inside the shaft of the first part.

15. A seal as claimed in claim 14, in which the shaft of the first part is at least partially made of a moulded electrically non-conductive material and the part of the conductive element of the electronic circuit carried by the first part inside the shaft of the first part is moulded into it.

16. A seal as claimed in claim 11, in which the electronic circuit carried by the first part defines also a secondary electrically conductive path which extends along the length of the shaft of the first part and which is electrically isolated from the primary conductive path, the circuit being configured to be in its warning state during electrical contact between its conductive paths.

17. A seal as claimed in claim 16, in which the secondary electrically conductive path of the electronic circuit carried by the first part is defined by an electrically conductive element.

18. A seal as claimed in claim 1, in which the head formed by the second part at the end of the shaft of the first part remote from the head of the first part, when the parts are interengaged, is made of a tamper resistant material.

19. A seal as claimed in claim 18, in which the second part is the part defining the receiving formation for the shaft of the third part; and the parts are shaped to provide an in-use configuration of the seal in which, with the shaft of the third part engaged with the second part, a portion of the shaft of the first part is received in the passage defined through the third part, the head of the first part is adjacent to the head of the third part, and the region of the shaft of the first part defining its engagement means projects from the shaft of the third part and is received within and irreleasibly engaged by the receiving formation defined for it by the second part.

20. A seal as claimed in claim 19, in which the receiving formation defined by the second part for receiving the region of the shaft of the third part defining its engagement means is a socket formation defining a generally round cylindrical inner surface of a diameter matching that of the shaft in the region referred to and that for the corresponding region of the shaft of the first part is a socket formation defining a generally round cylindrical inner surface of a diameter matching that of the shaft in the region referred to, co-axial with the former cylindrical surface, the latter socket formation daylighting in the former.

21. A seal as claimed in claim 1, in which the part defining the receiving formation for the shaft of the third part is a fourth part;

with the third part engaged with the fourth part, the combination of the two parts defines a tamper resistant seal body comprising the two heads of the respective parts and the shaft of the third part interconnecting them, the seal body defining therethrough, particularly also through its shaft, a passage for receiving the shaft of the first part, the passage daylighting on opposite ends thereof in the respective heads of the seal body; and the parts are shaped to provide an in-use configuration of the seal in which, with the third part engaged with the fourth part to define a tamper resistant seal body, a portion of the shaft of the first part is received in the passage defined through the seal body and the first part is engaged with the second part with the heads of these parts on opposite sides of the seal body.

22. A seal as claimed in claim 21, in which the receiving formation defined by the fourth part for receiving the region of the shaft of the third part defining its engagement means defines a generally round cylindrical inner surface of a diameter matching that of the shaft in the region referred to.

* * * * *

UNITED STATES PATENT AND TRADEMARK OFFICE

CERTIFICATE OF CORRECTION

PATENT NO. : 7,557,706 B2
APPLICATION NO. : 10/571646
DATED : July 7, 2009
INVENTOR(S) : Andrew G. L. Brown It is certified that error appears in the above-identified patent and that said Letters Patent is hereby corrected as shown below:

On the Title Page:

At field (73), remove "Adams & Adams, Pretoria (ZA)" as the Assignee.

At field (22), "Jun. 24, 2004" should be -- Jun. 14, 2004 --.

Signed and Sealed this

Sixth Day of April, 2010

David J. Kappos

David J. Kappos
*Director of the United States Patent and Trademark Office*